United States Patent [19]

Lenosky

[11] Patent Number: 4,578,829

[45] Date of Patent: Apr. 1, 1986

[54] ELEVATED TOILET SEAT INCLUDING CLAMPING MEANS

[75] Inventor: Theodore Lenosky, Fairfield, N.J.

[73] Assignee: Maddak, Inc., Pequannock, N.J.

[21] Appl. No.: 773,946

[22] Filed: Sep. 9, 1985

Related U.S. Application Data

[63] Continuation-in-part of Ser. No. 604,532, Apr. 27, 1984, abandoned.

[51] Int. Cl.[4] ..... A47K 13/00

[52] U.S. Cl. ..... 4/237

[58] Field of Search ..... 4/235, 237, 239

[56] References Cited

U.S. PATENT DOCUMENTS

| | | | |
|---|---|---|---|
| 1,441,719 | 1/1923 | Almorth | 4/239 |
| 2,955,296 | 10/1960 | Zapolski | 4/239 |
| 3,086,223 | 4/1963 | Gass | 4/237 |
| 3,490,082 | 1/1970 | Murcott | 4/239 |
| 4,214,323 | 7/1980 | Thomas | 4/239 X |
| 4,254,514 | 3/1981 | Sakamoto | 4/239 X |

FOREIGN PATENT DOCUMENTS

| | | | |
|---|---|---|---|
| 1205515 | 2/1960 | France | 4/237 |

*Primary Examiner*—Charles E. Phillips
*Attorney, Agent, or Firm*—Anthony F. Cuoco

[57] ABSTRACT

A toilet seat is disposed in an elevated position relative to the bowl of a conventional toilet. The toilet seat has a plurality of clamps disposed around its underside. Each of the clamps engages the toilet bowl, whereby the toilet seat is securely maintained in the elevated position so as to be an aid for invalids and others who experience difficulty in using a conventional toilet seat.

6 Claims, 4 Drawing Figures

ELEVATED TOILET SEAT INCLUDING CLAMPING MEANS

CROSS-REFERENCE TO RELATED APPLICATIONS

This application is a Continuation-In-Part of U.S. application Ser. No. 604,532, now abandoned, filed by Theodore Lenosky on Apr. 27, 1984.

BACKGROUND OF THE INVENTION

Prior to the present invention invalids and others who experience difficulty in sitting on and raising from a conventional toilet seat have used raised toilet seats which are superimposed upon conventional toilets. The raised superimposed toilet seats are disposed directly on the bowl of the conventional toilet and afford comfort to the user as is desired. Clamps have been provided to securely mount the raised superimposed seats to the conventional toilet. Raised superimposed toilet seats of this type are described and claimed in commonly assigned U.S. Pat. Nos. 4,462,122 issued on July 31, 1984 to John Broeils and 4,477,932 issued on Oct. 23, 1984 to Theodore Lenosky.

Raised superimposed toilet seats, while serving the desired purposes, have a configuration which differs significantly from that of a conventional toilet seat. This is a disadvantage which can be a deterrent to their use.

The elevated toilet seat of the present invention overcomes this disadvantage. The toilet seat resembles that of a conventional toilet seat and clamps are provided for clamping the seat to the bowl of a conventional toilet.

Accordingly, it is an object of the present invention to provide an elevated toilet seat including clamping means for adjustably clamping the toilet seat to the bowl of a conventional toilet, whereby the disadvantages of other toilet seat arrangements for like purposes are overcome.

SUMMARY OF THE INVENTION

This invention contemplates an elevated toilet seat including clamping means, whereby the seat has a plurality of clamps disposed on the underside thereof. Each of the clamps removably engages the rim of the bowl of a conventional toilet, whereby the seat is maintained in an elevated position relative to the bowl. The clamps may be tightened against the toilet bowl rim to secure the seat thereto so as to provide the appropriate degree of stability.

DETAILED DESCRIPTION OF THE INVENTION

Figure 1:
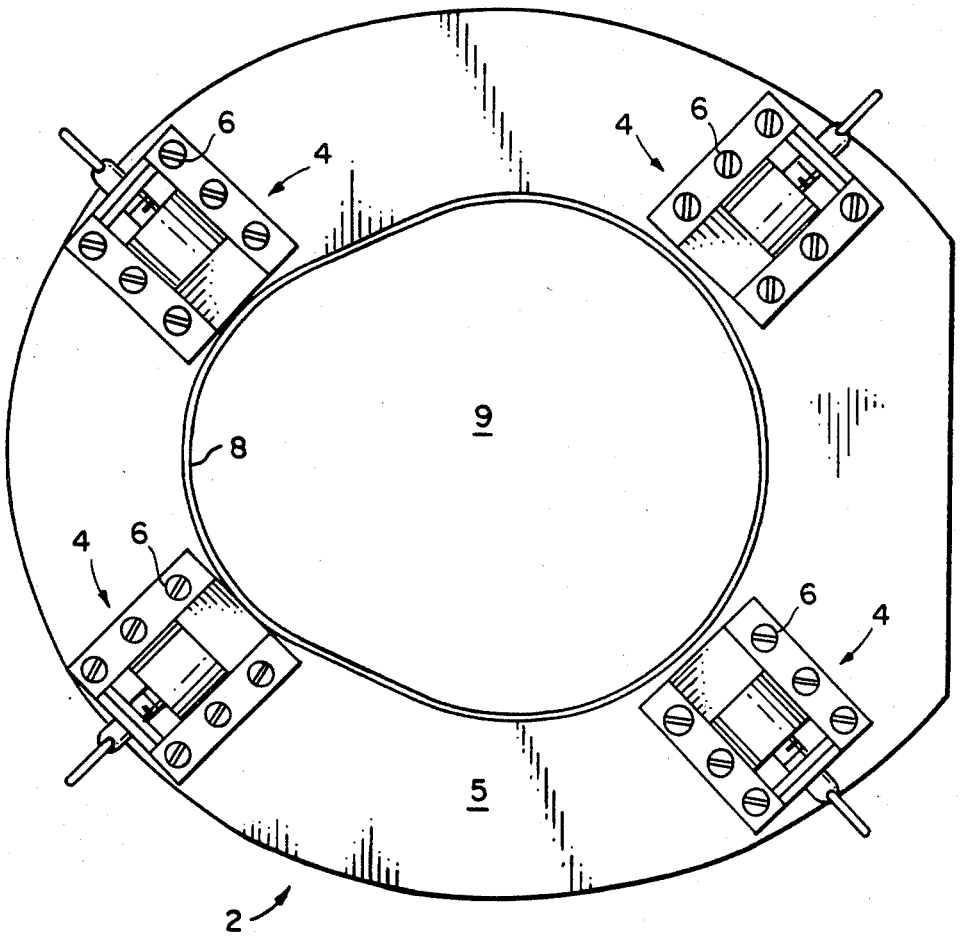
FIG. 1 is a bottom view of an elevated toilet seat according to the invention and showing clamps arranged on the underside thereof.

With reference first to FIG. 1 a toilet seat is designated by the numeral 2. Toilet seat 2 may be a conventional, commercially available toilet seat without the usual hinging mechanism whereby the seat is hinged to a conventional toilet so as to be raised and lowered relative thereto. In this connection seat 2 may be of pressed wood or plastic, or any other material from which conventional toilet seats are made.

A plurality of clamps, shown for purposes of illustration as four in number and carrying the numerical designation 4, are disposed around the underside 5 of toilet seat 2 and secured thereto by rivets, bolts, screws or the like 6. Clamps 4 are spaced around seat underside 5 to provide an appropriate degree of stability when the clamps engage a conventional toilet bowl to clamp the seat to the bowl as will hereinafter become evident. Clamps 4 may be molded of a suitable plastic material.

A splash guard 8 of a suitable plastic material surrounds opening 9 and extends from underside 5 and into the conventional toilet bowl when the elevated toilet seat described herein is used therewith so as to provide a sanitary feature as will be readily understood.

Figure 3:
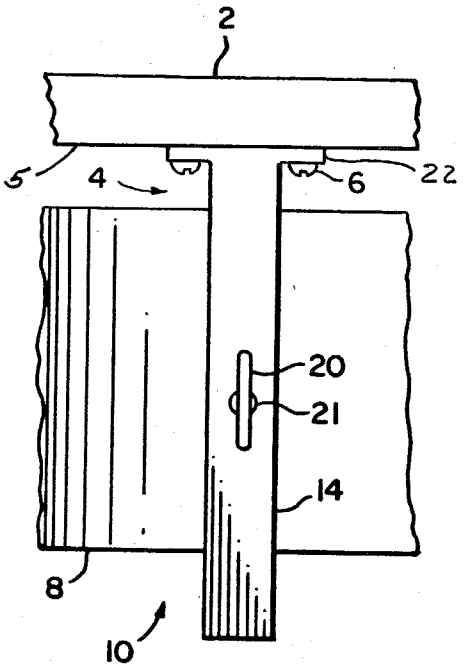
FIG. 3 is an end view particularly showing a clamp arranged with a toilet seat.
Figure 2:
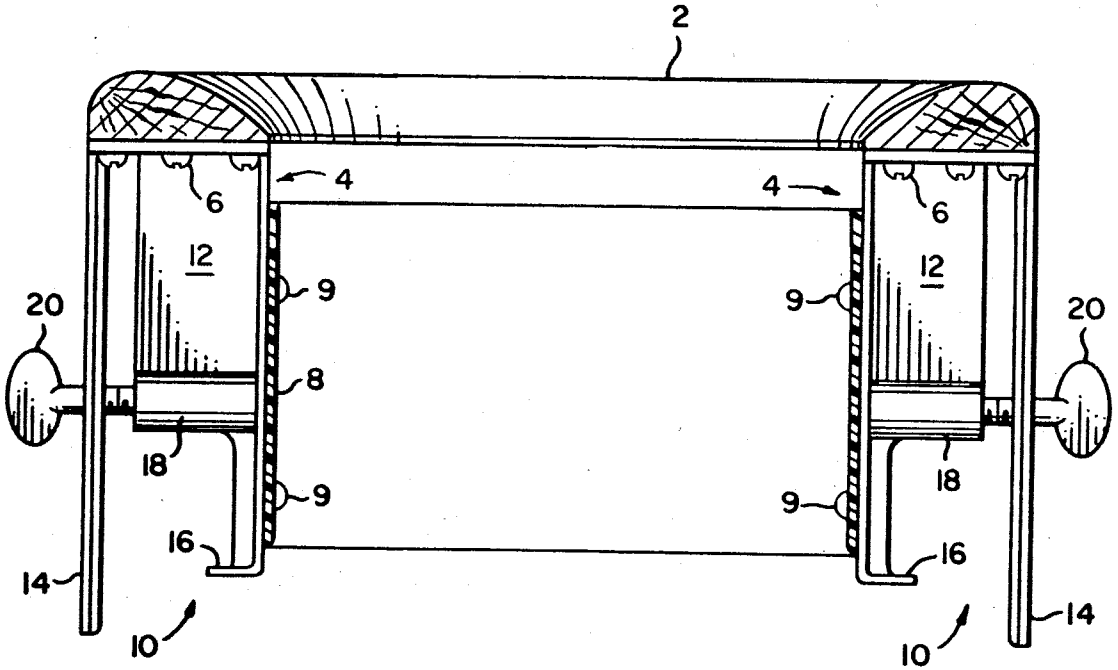
FIG. 2 is a sectional view particularly showing the clamps arranged according to the invention.

With reference to FIGS. 2 and 3, clamps 4 are shown with splash guard 8 being secured to the inside of the clamps by suitable means 9.

Figure 4:
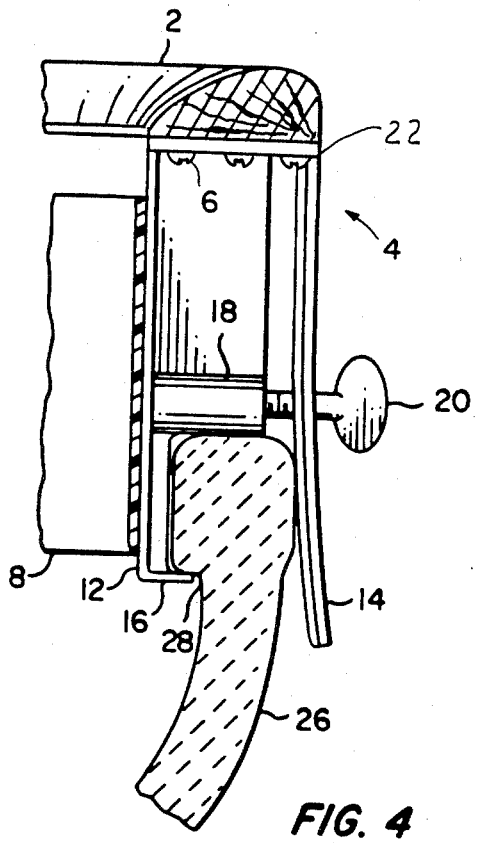
FIG. 4 is a side view showing a clamp arranged with the rim of a conventional toilet bowl.

Clamps 4 are seen as having a relatively thick inside leg 12 to which splash guard 8 is secured and a relatively thin outside leg 14 integral with but in spaced relation to leg 12, whereby leg 14 is displaceable away from and toward leg 12 as best shown in FIG. 4.

Clamp leg 12 carries a lip 16 at its lower end and a threaded bushing 18 above lip 16. Bushing 18 receives in threaded engagement a bolt or screw or the like 20 which extends through a hole 21 in leg 14 (FIG. 3), whereby clamp 10 may be tightened against the rim of a conventional toilet bowl as will be hereinafter further described with reference to FIG. 4.

As shown in FIG. 2, leg 14 extends beyond leg 12 so as to extend beyond the rim of the conventional toilet bowl as shown in FIG. 4. With reference now to FIG. 3, clamps 4 have an upper portion or base 22 which is secured to underside 5 of seat 2 as aforenoted.

The arrangement of clamps 4 with a conventional toilet bowl 26 is best illustrated in FIG. 4. It will be noted that conventional bowls 26 have a flanged rim 28 at least on the inside thereof. Lip 16 of clamp leg 12 engages flanged rim 28. Leg 14, which is displaceable away from and toward member 12 as aforenoted, is adjacent the outside of bowl 26 when clamps 4 are arranged with bowl 6 as shown in FIG. 4. Screw 20 may be tightened to secure clamp lip 16 to flanged rim 28 of toilet bowl 26 as will now be understood.

The elevated toilet seat including clamping means described herein provides a toilet seat arrangement wherein the toilet seat resembles the configuration of a conventional toilet seat. The arrangement described maximizes user comfort and stability and enhances the use of toilet seats by invalids and others who suffer immobilizing infirmities to the extent that they are unable to use conventional toilet seats.

With the aforegoing description of the invention in mind reference is had to the appended claims for a definition of the scope of the invention.

What is claimed is:

1. Elevated toilet seat including clamping means for use with a toilet having a bowl with a flanged rim at least on the inside thereof, characterized by:

the toilet seat disposed above the toilet bowl in an elevated position;

a plurality of clamps disposed around the underside of the toilet seat;

each of the clamps engaging the flanged toilet bowl rim;

each of the clamps including means for tightening the clamps against the flanged rim, whereby the toilet seat is secured to the toilet bowl in the elevated position;

each of the clamps having a relatively thick first leg, a relatively thin second leg and a base, said first and second legs and said base being integral, and said first and second legs being in spaced relation and displaceable relative to each other;

the second leg being longer than the first leg and said first leg carrying an inwardly extending lip on its lower end which engages the flanged toilet bowl rim, and the base being disposed on the underside of the toilet seat; and the second leg being displaced relative to the first leg to be adjacent the outside of the toilet bowl when the clamp is tightened against the flanged rim.

2. Elevated toilet seat and clamping means as described by claim 1, wherein the means for tightening the clamps against the flanged rim is characterized by:

the first clamp leg carrying an internally threaded bushing;

an externally threaded member extending through the second clamp leg and engaging the bushing in threaded relationship and adjusted relative thereto, whereby the clamp is tightened and the first and second legs are displaced relative to each other, with the second clamp leg adjacent the outside of the toilet bowl and the lip carried by the first clamp leg engaging the flanged rim on the inside of the toilet bowl.

3. Elevated toilet seat including clamping means as described by claim 1, characterized by:

a splash guard supported by the clamps and extending downward from the underside of the toilet seat.

4. Elevated toilet seat including clamping means as described by claim 1, characterized by:

a splash guard secured to the first legs of the clamps and extending downward from the underside of the toilet seat.

5. Elevated toilet seat including clamping means as described by claim 1, characterized by:

the plurality of clamps disposed around the underside of the toilet seat being arranged in predetermined spaced relation to provide a required degree of stability when the clamps engage the flanged toilet bowl rim for securing the toilet seat in the elevated position.

6. Elevated toilet seat including clamping means as described by claim 1, characterized by:

the plurality of clamps disposed around the underside of the toilet seat including four clamps.

* * * * *